US012805671B2

(12) United States Patent
Williams

(10) Patent No.: US 12,805,671 B2
(45) Date of Patent: Nov. 24, 2026

(54) ENHANCED CLEANING WIPES

(71) Applicant: Shannon Williams, Houston, TX (US)

(72) Inventor: Shannon Williams, Houston, TX (US)

( * ) Notice: Subject to any disclaimer, the term of this patent is extended or adjusted under 35 U.S.C. 154(b) by 292 days.

(21) Appl. No.: 18/641,027

(22) Filed: Apr. 19, 2024

(65) Prior Publication Data

US 2025/0325152 A1 Oct. 23, 2025

(51) Int. Cl.
*A47K 7/02* (2006.01)
*A47K 7/03* (2006.01)

(52) U.S. Cl.
CPC . *A47K 7/02* (2013.01); *A47K 7/03* (2013.01)

(58) Field of Classification Search
CPC .. A47K 7/02; A47K 7/03; A47L 13/18; A47L 13/19; A47L 23/10; B32B 2432/00
See application file for complete search history.

(56) References Cited

U.S. PATENT DOCUMENTS 2,179,614 A * 11/1939 Cohen ..... A47L 17/06 15/229.13
2,621,784 A * 12/1952 Van Boytham ..... A45D 33/34 156/716
2,795,806 A * 6/1957 Suttles ..... A47L 13/19 401/270
3,299,464 A * 1/1967 O'Brien ..... A47L 25/08 206/229
4,797,967 A * 1/1989 Lengers ..... A47L 13/18 15/118
4,902,283 A * 2/1990 Rojko ..... A47K 7/02 294/1.3
4,932,095 A * 6/1990 Kawase ..... A45D 44/00 2/167
5,045,073 A * 9/1991 Wagner ..... A61M 35/003 401/7
5,127,127 A * 7/1992 Jarosinski ..... A47L 13/18 401/6
5,616,201 A * 4/1997 Finch ..... A47K 10/421 156/227
5,644,813 A * 7/1997 Puskas ..... A47L 13/282 36/59 C
5,864,883 A * 2/1999 Reo ..... A41D 19/0055 2/161.6
5,987,645 A * 11/1999 Teaster ..... A41D 19/0068 2/161.6
6,122,793 A * 9/2000 Pao ..... A47L 13/20 36/7.1 R
6,145,155 A * 11/2000 James ..... A47L 13/19 15/118
6,290,418 B1 * 9/2001 Frey ..... A47L 23/10 401/126
6,430,771 B2 * 8/2002 Ahern ..... A47L 13/282 15/118

(Continued)

FOREIGN PATENT DOCUMENTS

DE 10145713 C1 * 1/2003 ..... A43B 3/00

*Primary Examiner* — Eret C McNichols
(74) *Attorney, Agent, or Firm* — Gray Ice Higdon, PLLC

(57) ABSTRACT

This disclosure describes cleaning wipes that can be used on surfaces and skin. The cleaning wipes may include a base sheet, and a sleeve portion with at least one of an adhesive portion or an elastic portion, wherein the sleeve portion is formed by folding at least a first portion of the base sheet and is configured to cover at least a portion of a person's fingers or hand while holding the cleaning wipe.

20 Claims, 6 Drawing Sheets

(56) References Cited

U.S. PATENT DOCUMENTS 6,536,971 B1 * 3/2003 Schouten ..... A47L 13/18 401/289
6,898,819 B2 * 5/2005 Tanaka ..... A46B 5/04 2/21
D553,315 S * 10/2007 Lynde ..... D32/40
7,484,261 B2 * 2/2009 Sigl ..... A47L 13/17 15/104.94
7,636,978 B2 * 12/2009 Blokpoel ..... A47L 23/05 15/104.94
8,584,684 B2 * 11/2013 Nakamura ..... A45D 29/007 2/21
9,433,329 B2 * 9/2016 Joseff ..... A47L 13/18
D774,266 S * 12/2016 Baldwin ..... D32/40
D779,142 S * 2/2017 Baldwin ..... D32/40
D796,762 S * 9/2017 Rush ..... D32/43
10,449,093 B2 * 10/2019 Seifert ..... B65D 85/62
D950,869 S * 5/2022 Palomino ..... A41D 23/00 D32/35
11,412,830 B2 * 8/2022 Silva ..... B32B 5/245
12,171,386 B2 * 12/2024 McKenzie ..... A47L 13/16
12,465,180 B1 * 11/2025 McIntosh ..... A45D 44/00
2001/0047534 A1 * 12/2001 Sandusky ..... A41D 19/01 2/158
2002/0178482 A1 * 12/2002 Samuelsson ..... A47K 7/02 2/16
2005/0217045 A1 * 10/2005 Minkler ..... A47L 13/19 15/104.94
2010/0064463 A1 * 3/2010 Beatty ..... B65H 45/00 15/209.1
2011/0289712 A1 * 12/2011 Scott ..... A47L 13/18 15/209.1
2014/0123419 A1 * 5/2014 Kirk ..... A47L 13/17 15/104.94
2015/0196171 A1 * 7/2015 Joseff ..... A47K 7/02 15/227
2015/0296745 A1 * 10/2015 Fridlin ..... A01K 29/00 15/227
2015/0305989 A1 * 10/2015 Lupano ..... A47K 7/02 15/210.1
2017/0087024 A1 * 3/2017 Al-Bakkour ..... A61F 13/01012
2017/0087598 A1 * 3/2017 Oboley ..... A47K 7/03
2018/0360289 A1 * 12/2018 Bystrom ..... A47L 13/18
2024/0215791 A1 * 7/2024 Stanton ..... A47L 13/12

* cited by examiner

ENHANCED CLEANING WIPES

TECHNICAL FIELD

Embodiments of the present invention generally relate to cleaning wipes.

BACKGROUND

Cleaning wipes, whether for cleaning surfaces or people, can be inefficient to use. For example, a person's hand may be exposed when using a cleaning wipe, and may come in contact with surfaces and substances in addition to the cleaning wipe because the cleaning wipe may not consistently cover the person's hand or fingers while wiping with the cleaning wipe.

DETAILED DESCRIPTION

Figure 1:
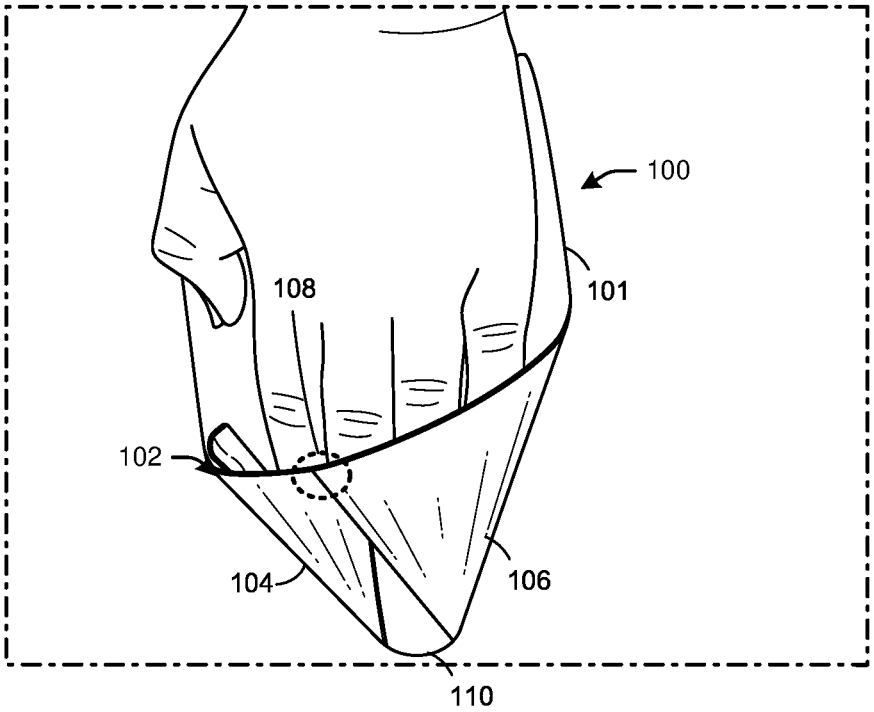
FIG. 1 illustrates an example perspective rear view of a cleaning wipe in accordance with one embodiment.

Aspects of the present disclosure involve enhanced cleaning wipes.

Cleaning wipes often fail to consistently cover a person's fingers or hand while wiping with them. One example is when using a cleaning wipe to wipe a baby during a diaper change. Reaching parts of a baby's body with a wipe may require maneuvering the wipe in ways that leave parts of the fingers or hand exposed. Similarly, when cleaning surfaces with wipes, the wipes may not completely cover a person's hand or fingers as the person wipes a surface, especially when reaching small spaces or applying the wipe at angles.

There is therefore a need for enhanced cleaning wipes that keep a person's fingers and hands covered when applying the cleaning wipes to people or object surfaces.

In one or more embodiments, the cleaning wipes herein may include one or more sleeve portions that remain over a person's fingers and/or hand while being held by the person and applied to a person or surface being cleaned. For example, an adhesive or elastic material may be used to create the sleeve portions. A person may insert their fingers and/or hand into a sleeve portion created by a sleeve portion so that when the person is wiping with the wipe, a portion of the person's fingers and/or hand are covered by the wipe as a result of the fingers and/or hand fitting within the sleeve portion formed by a sleeve portion and a wiping portion of the wipe.

In one or more embodiments, the sleeve portion of the wipes may be conical in shape. To form a conical sleeve portion of the wipes herein, a portion proximal to a first side of the wipes (e.g., rectangular-shaped wipes) may be folded toward the opposite side of the wipes to form a cone-like sleeve at the first side of the wipes. An adhesive may be used to attach portions of the first side of the wipes that are folded back. For example, two corners on one side of a rectangular wipe may be folded back and adhered to each other to form a conical sleeve portion. A persons finger's and/or hand may fit into the sleeve portion such that the non-conical portion represents a main wiping surface. Because the conical sleeve portion may be formed using the wipe, the conical sleeve portion also may be used for wiping. The smaller "tip" of the conical portion may be rounded to avoid any uncomfortable poking when the wipe is used as a baby wipe.

In one or more embodiments, the sleeve portion of the wipes may be formed by pulling back an outer portion of a wipe to create a sleeve into which a person's fingers and/or hand may fit. To hold the outer portion of the wipe in place to form the sleeve portion, an adhesive or elastic may be used so that a main wiping surface may be circular, and the sleeve portion on the opposite side of the main wiping surface may represent a ring shape such that the wipe may fit over the person's fingers/hand like a mitt. The person's fingers/hand may be inserted into the ring shaped-sleeve portion to allow the person to hold the wipe and cover their fingers/hand while wiping with the fingers/hand within the sleeve portion.

In one or more embodiments, the sleeve portion of the wipes may be formed by pulling back an outer portion of the wipe to create a partial ring shaped-sleeve portion. For example, using a rectangular-shaped wipe, one side and portions of two connecting sides of the wipe may be pulled back to create a sleeve that does not completely extend around the entire perimeter of the wipe. For example, such a sleeve portion may form an arch shape. An adhesive may be used to hold portion of the sleeve portion in place to cover a person's fingers/hand while wiping with the wipe.

In one or more embodiments, to form the sleeve portions of the wipes herein, only a single base sheet of a wipe may be needed. With proper folding and forming of the sleeve portions, the manufacture of the wipes may be simplified, as the base sheets may be formed as single sheets, and then folded to form the sleeves that cover hands/fingers of a person holding them for cleaning.

In one or more embodiments, base sheets (e.g., cloths) of the wipes herein may use one or more substances for cleaning formulation, including water or cleaning solutions. Water, detergents, surfactants, preservatives, pH adjusting materials (e.g., organic acids, conjugate bases, etc.), skin improving agents (e.g., butoxy PEG-4 PG-amodimethicone, xanthan gum, glycerin, behenyl alcohol, etc.), and object surface cleaning solutions may be mixed with the material of the wipes, depending on the cleaning application for which the wipes are used.

In one or more embodiments, base sheets (e.g., cloths) of the wipes herein may use one or more materials, such as nonwoven fabrics that include polyester, polypropylene, cotton, rayon, polyethylene, and the like.

The above descriptions are for purposes of illustration and are not meant to be limiting. Numerous other examples, configurations, processes, etc., may exist, some of which are described in greater detail below. Example embodiments will now be described with reference to the accompanying figures.

FIG. 1 illustrates an example perspective rear view of a cleaning wipe 100 in accordance with one embodiment.

Referring to FIG. 1, the cleaning wipe 100 may include a base sheet 101 with a sleeve portion 102 into which a person may insert their fingers and/or hand. The sleeve portion 102 may be formed by folding two portions (e.g., portion 104, portion 106) of the base sheet 101 and connecting the two portions (e.g., at a connection location 108), such as by using an adhesive material. The sleeve portion 102 may form a conical shape, and a tip 110 of the sleeve portion 102 may be curved to be more comfortable to a person's skin (e.g., when the cleaning wipe 100 is being used as a baby wipe).

Figure 2:
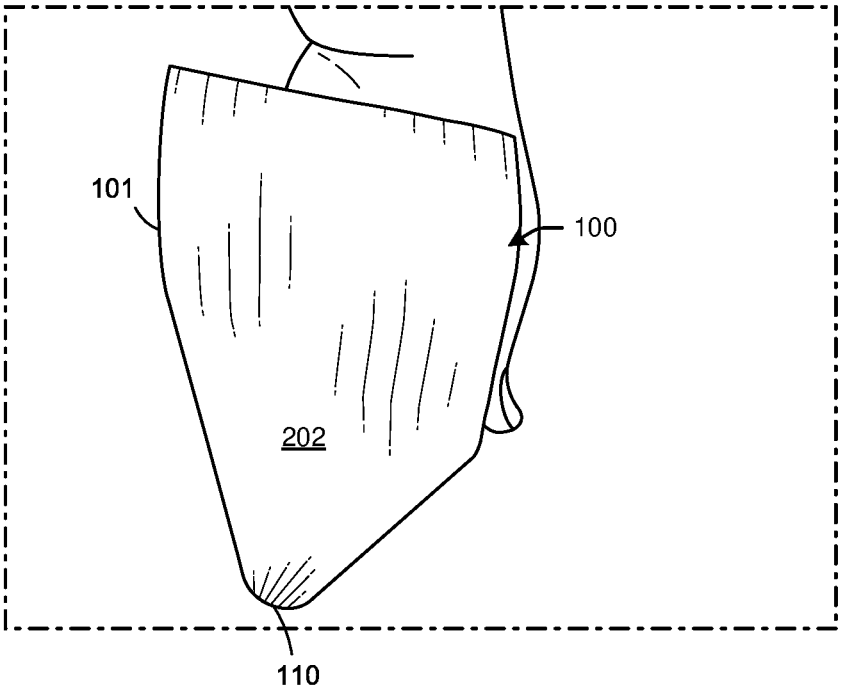
FIG. 2 illustrates an example perspective front view of the cleaning wipe of FIG. 1 in accordance with one embodiment.

FIG. 2 illustrates an example perspective front view of the cleaning wipe 100 of FIG. 1 in accordance with one embodiment.

Referring to FIG. 2, on the opposite side of the cleaning wipe 100 from the sleeve portion 102 of FIG. 1 is a main cleaning surface 202 of the base sheet 101. As shown, the forming of the sleeve portion 102 may result in the curved tip 110. In this manner, the main cleaning surface 202 be exposed to surfaces and/or skin while wiping with the cleaning wipe 100, and the sleeve portion 102 may protect a user's hand or fingers while wiping with the cleaning wipe 100.

Figure 3:
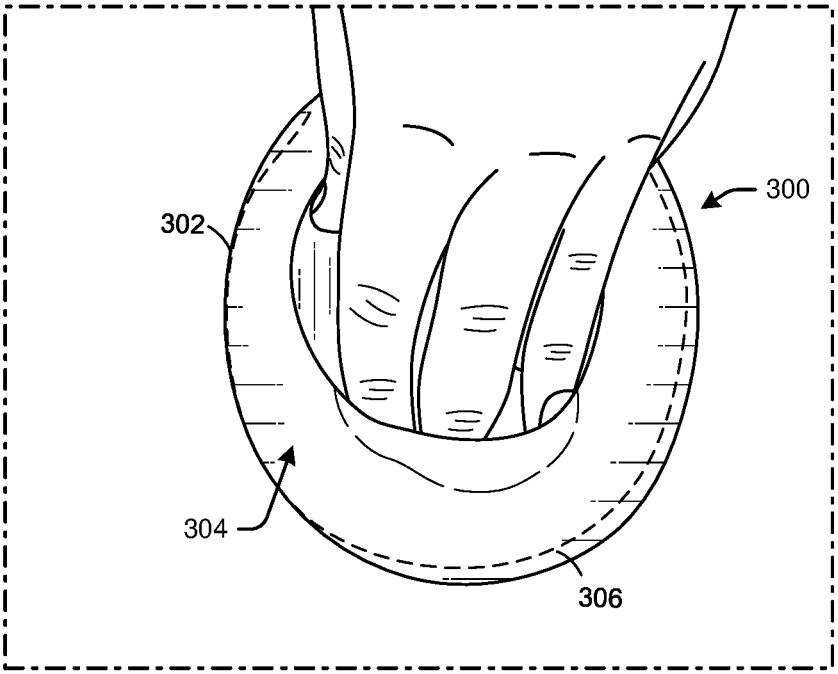
FIG. 3 illustrates an example perspective rear view of a cleaning wipe in accordance with one embodiment.

FIG. 3 illustrates an example perspective rear view of a cleaning wipe 300 in accordance with one embodiment.

Referring to FIG. 3, the cleaning wipe 300 may include a base sheet 302 that may be round in shape. The base sheet 302 may be folded to form a sleeve portion 304 into which a person may insert their fingers and/or hand. To form and hold the sleeve portion 304 in place, an elastic or adhesive material 306 may be positioned inside of the sleeve portion 304 around the outer perimeter of the base sheet 302 and the sleeve portion 304 (e.g., where the base sheet 302 is folded to form the sleeve portion 304). For example, when the elastic or adhesive material 306 includes an elastic (e.g., a rubber band or other elastic band), the elastic may be held in place by an adhesive material inside of the sleeve portion 304. Alternatively, the folded portion of the base sheet 302 that forms the sleeve portion 304 may be adhered directly to the base sheet 302 to form the sleeve portion 304.

Figure 4:
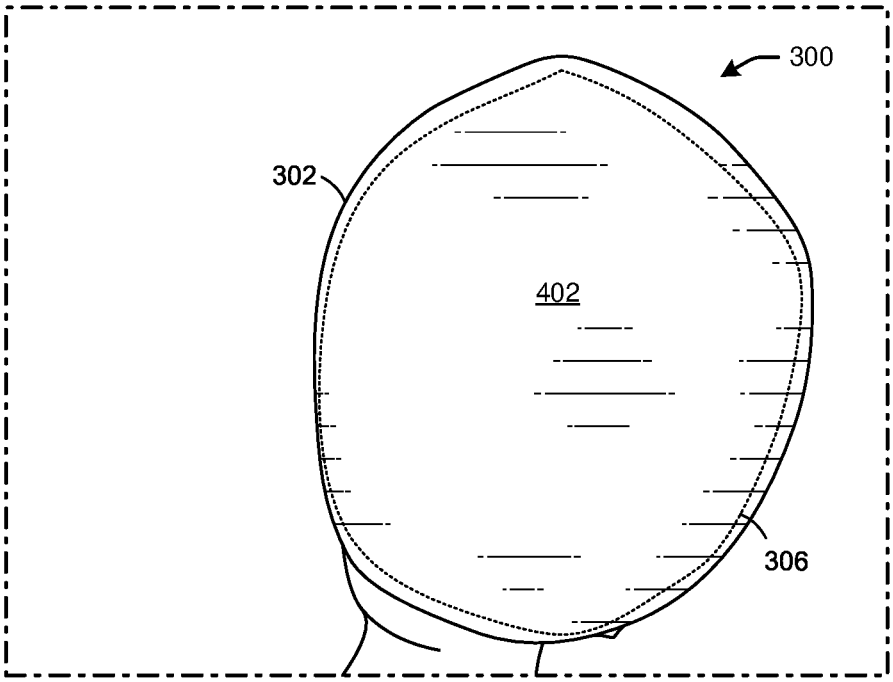
FIG. 4 illustrates an example perspective front view of the cleaning wipe of FIG. 3 in accordance with one embodiment.

FIG. 4 illustrates an example perspective front view of the cleaning wipe 300 of FIG. 3 in accordance with one embodiment.

Referring to FIG. 4, on the opposite side of the cleaning wipe 300 from the sleeve portion 304 of FIG. 3 is a main cleaning surface 402 of the base sheet 302. In this manner, the main cleaning surface 402 be exposed to surfaces and/or skin while wiping with the cleaning wipe 300, and the sleeve portion 304 (e.g., held in place by the elastic or adhesive material 306) may protect a user's hand or fingers while wiping with the cleaning wipe 300.

Figure 5:
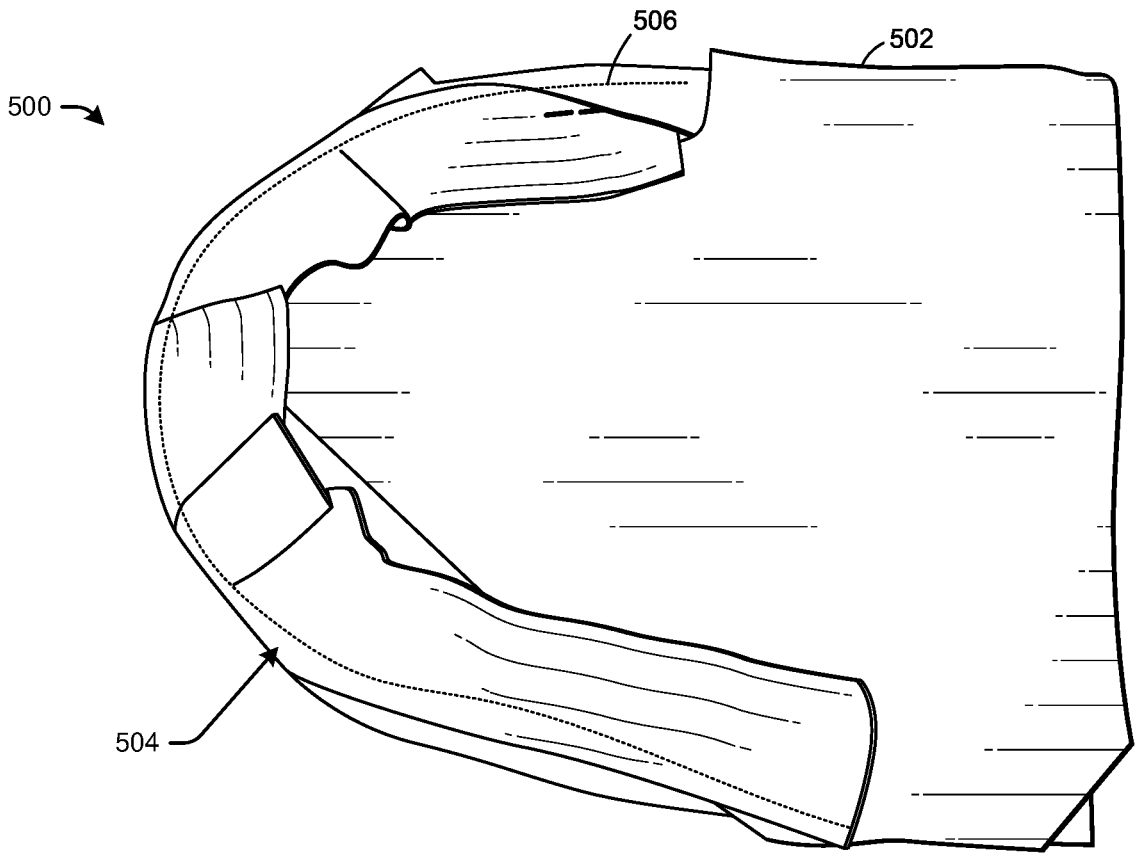
FIG. 5 illustrates an example perspective rear view of a cleaning wipe in accordance with one embodiment.

FIG. 5 illustrates an example perspective rear view of a cleaning wipe 500 in accordance with one embodiment.

Referring to FIG. 5, the cleaning wipe 500 may include a base sheet 502 with a portion folded back to form a sleeve portion 504 to cover at least a portion of a person's fingers and/or hand. The sleeve portion 504 may be round in shape, forming an arch due to the sleeve portion 504 not completely extending around the entire perimeter of the base sheet 502. To form and hold the sleeve portion 504 in place, an elastic or adhesive material 506 may be positioned inside of the sleeve portion 504 around the outer perimeter of the base sheet 502 and the sleeve portion 504 (e.g., where the base sheet 502 is folded to form the sleeve portion 504). For example, when the elastic or adhesive material 506 includes an elastic (e.g., a rubber band or other elastic band), the elastic may be held in place by an adhesive material inside of the sleeve portion 504. Alternatively, the folded portion of the base sheet 502 that forms the sleeve portion 504 may be adhered directly to the base sheet 502 to form the sleeve portion 504.

Figure 6:
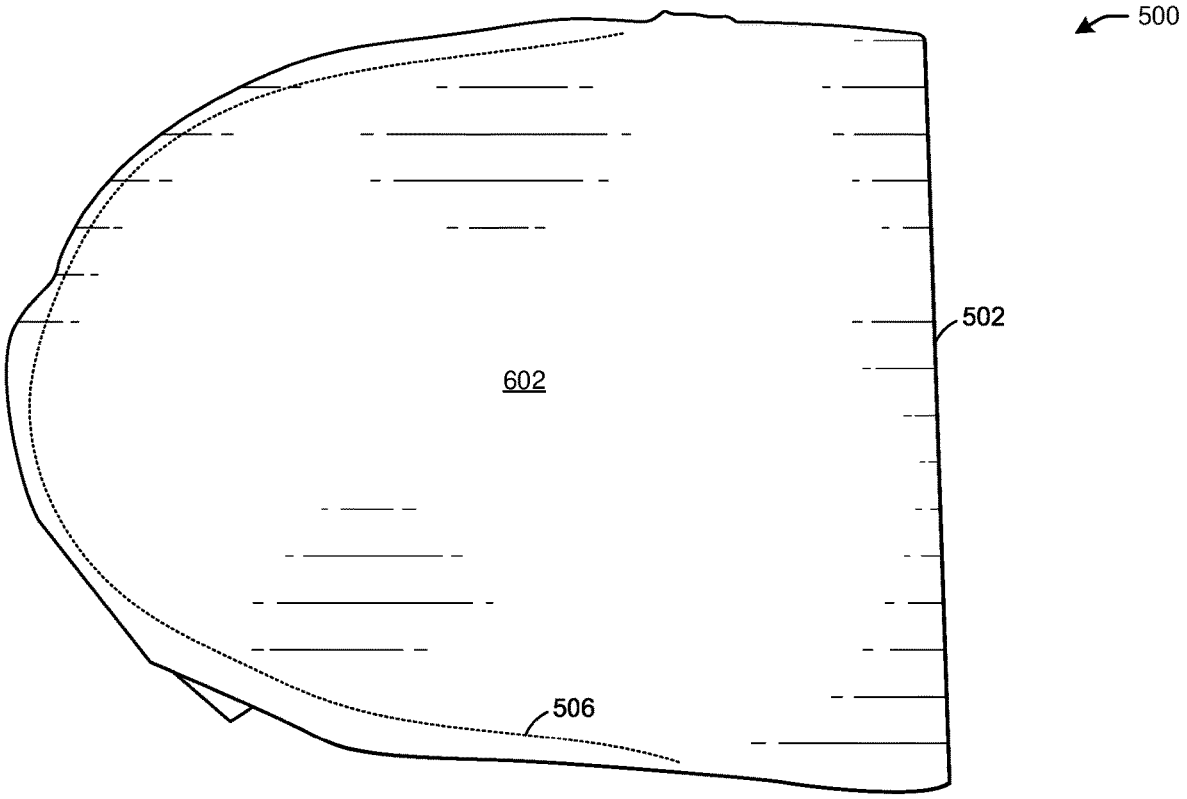
FIG. 6 illustrates an example perspective front view of the cleaning wipe of FIG. 5 in accordance with one embodiment.

FIG. 6 illustrates an example perspective front view of the cleaning wipe 500 of FIG. 5 in accordance with one embodiment.

Referring to FIG. 6, on the opposite side of the cleaning wipe 500 from the sleeve portion 504 of FIG. 5 is a main cleaning surface 602 of the base sheet 502. In this manner, the main cleaning surface 602 be exposed to surfaces and/or skin while wiping with the cleaning wipe 500, and the sleeve portion 504 (e.g., held in place by the elastic or adhesive material 506) may protect a user's hand or fingers while wiping with the cleaning wipe 500.

Referring to FIGS. 1-6, the cleaning wipes may be used for cleaning surfaces or skin.

In one or more embodiments, to form the sleeve portions of the wipes in FIGS. 1-6, only a single base sheet of a wipe may be needed. With proper folding and forming of the sleeve portions, the manufacture of the wipes may be simplified, as the base sheets may be formed as single sheets, and then folded to form the sleeves that cover hands/fingers of a person holding them for cleaning.

In one or more embodiments, base sheets (e.g., cloths) of the wipes of FIGS. 1-6 may use one or more substances for cleaning formulation, including water or cleaning solutions. Water, detergents, surfactants, preservatives, pH adjusting materials (e.g., organic acids, conjugate bases, etc.), skin improving agents (e.g., butoxy PEG-4 PG-amodimethicone, xanthan gum, glycerin, behenyl alcohol, etc.), and object surface cleaning solutions may be mixed with the material of the wipes, depending on the cleaning application for which the wipes are used.

In one or more embodiments, base sheets (e.g., cloths) of the wipes of FIGS. 1-6 may use one or more materials, such as nonwoven fabrics that include polyester, polypropylene, cotton, rayon, polyethylene, and the like.

It is understood that the above descriptions are for purposes of illustration and are not meant to be limiting.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations together with all equivalents thereof.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language is not generally intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed:

1. A cleaning wipe comprising:

a unitary sheet of flexible material comprising one or more internal fold lines dividing the unitary sheet into a main wiping panel and a sleeve panel, wherein the sleeve panel structurally overlays a portion of the main wiping panel to define an integrated finger-receiving pocket between the panels;

an attachment portion comprising at least one of an adhesive or an elastic material, wherein the sleeve panel maintains the structurally overlaying position by being secured to the main wiping panel by the attachment portion, and wherein the finger-receiving pocket comprises an opening defined by an unattached edge of the sleeve panel, the opening extending continuously across a transverse dimension of the main wiping panel.

2. The cleaning wipe of claim 1, wherein the finger-receiving pocket is conical in shape.

3. The cleaning wipe of claim 2, wherein the attachment portion comprises an adhesive securing a first segment of the sleeve panel to a second segment of the sleeve panel to maintain the conical shape.

4. The cleaning wipe of claim 3, wherein the finger-receiving pocket comprises a rounded tip at a closed end positioned opposite the opening.

5. The cleaning wipe of claim 1, wherein sleeve panel spans an entire perimeter of the main wiping panel.

6. The cleaning wipe of claim 5, wherein the attachment portion comprises an adhesive securing the sleeve panel to the main wiping panel along the perimeter.

7. The cleaning wipe of claim 5, wherein the attachment portion comprises an elastic band arranged along the perimeter.

8. The cleaning wipe of claim 1, wherein the sleeve panel forms an arch spanning less than an entire perimeter of the main wiping panel.

9. The cleaning wipe of claim 8, wherein the attachment portion comprises an adhesive securing the sleeve panel to the main wiping panel along the less than the entire perimeter.

10. The cleaning wipe of claim 8, wherein the attachment portion comprises an elastic band arranged along the less than the entire perimeter.

11. A cleaning wipe comprising:

a unitary sheet of flexible material comprising one or more internal fold lines dividing the unitary sheet into a main wiping panel and a curved sleeve panel, wherein the curved sleeve portion structurally overlays a portion of the main wiping panel to define an integrated finger-receiving pocket between the panels; and an attachment portion comprising at least one of an adhesive or an elastic material, wherein the curved sleeve panel maintains the structurally overlaying position by being secured to the main wiping panel by the attachment portion, wherein the finger-receiving pocket comprises an opening defined by an unattached edge of the curved sleeve panel, the opening extending continuously across a transverse dimension of the main wiping panel.

12. The cleaning wipe of claim 11, wherein the curved sleeve panel is conical in shape.

13. The cleaning wipe of claim 12, wherein the finger-receiving pocket comprises a rounded tip at a closed end positioned opposite the opening.

14. The cleaning wipe of claim 11, wherein curved sleeve panel spans an entire perimeter of the main wiping panel.

15. The cleaning wipe of claim 14, wherein the attachment portion comprises an adhesive securing the curved sleeve panel to the main wiping panel along the perimeter.

16. The cleaning wipe of claim 14, wherein the attachment portion comprises an elastic band arranged along the perimeter.

17. The cleaning wipe of claim 11, wherein the curved sleeve panel forms an arch spanning less than an entire perimeter of the main wiping panel.

18. A baby wipe, comprising:

a unitary sheet of flexible material comprising one or more internal fold lines dividing the unitary sheet into a main wiping panel and a sleeve panel, wherein the sleeve panel structurally overlays a portion of the main wiping panel to define an integrated finger-receiving pocket between the panels; and an attachment portion comprising at least one of an adhesive or an elastic material, wherein the sleeve panel maintains the structurally overlaying position by being secured to the main wiping panel by the attachment portion, and wherein the finger-receiving pocket comprises an opening defined by an unattached edge of the sleeve panel, the opening extending continuously across a transverse dimension of the main wiping panel.

19. The baby wipe of claim 18, wherein the sleeve panel is conical in shape.

20. The baby wipe of claim 18, wherein the sleeve panel spans at least a portion of a perimeter of the main wiping panel.

* * * * *